US011446615B2

(12) United States Patent
Nieuwoudt et al.

(10) Patent No.: US 11,446,615 B2
(45) Date of Patent: Sep. 20, 2022

(54) STATIC MIXING DEVICES AND METHOD OF MANUFACTURE

(71) Applicant: Koch-Glitsch, LP, Wichita, KS (US)

(72) Inventors: Izak Nieuwoudt, Wichita, KS (US); Clarence Armbrister, Wichita, KS (US)

(73) Assignee: Koch-Glitsch, LP, Wichita, KS (US)

( * ) Notice: Subject to any disclaimer, the term of this patent is extended or adjusted under 35 U.S.C. 154(b) by 984 days.

(21) Appl. No.: 16/122,470

(22) Filed: Sep. 5, 2018

(65) Prior Publication Data

US 2019/0076800 A1 Mar. 14, 2019

Related U.S. Application Data

(60) Provisional application No. 62/555,875, filed on Sep. 8, 2017.

(51) Int. Cl.
*B01F 25/421* (2022.01)
*B01F 25/431* (2022.01)

(52) U.S. Cl.
CPC ..... *B01F 25/4231* (2022.01); *B01F 25/4311* (2022.01); *B01F 25/43161* (2022.01); *B01F 25/4315* (2022.01)

(58) Field of Classification Search
CPC ..... B01F 25/4231; B01F 25/431; B01F 25/4311; B01F 25/4314; B01F 25/43141;
(Continued)

(56) References Cited

U.S. PATENT DOCUMENTS 4,643,584 A 2/1987 Allocca
5,378,063 A 1/1995 Tsukada
(Continued)

FOREIGN PATENT DOCUMENTS

CN 202191855 U 4/2012
CN 202237835 U 5/2012
(Continued)

OTHER PUBLICATIONS

International Search Report & Written Opinion, for corresponding PCT Application No. PCT/IB2018/056785, 11 pages.
(Continued)

*Primary Examiner* — Marc C Howell

(57) ABSTRACT

A static mixing device subassembly that can be joined with other static mixing device subassemblies to form a static mixing device. The subassembly comprises a first pair of intersecting grids of spaced-apart and parallel deflector blades and a second pair of intersecting grids of spaced-apart and parallel deflector blades. The deflector blades in each one of the grids are interleaved with the deflector blades in the paired intersecting grid and have uncut side portions that join them together along a transverse strip where the deflector blades cross each other and cut side portions that extend from the uncut side portions to the ends of the deflector blades. Each of the deflector blades in one of the grids in each pair of grids has a bent portion that places segments of the deflector blade on opposite sides of the uncut portion in offset parallel planes. Some or all of the deflector blades in the other one of the grids in one of the pairs of grids has uncut ends that are interconnected with uncut ends of deflector blades in the other one of the grids in the other one of the pairs of grids along a reverse bend that aligns one of the pairs of grids with the other pair of grids.

21 Claims, 9 Drawing Sheets

(58) Field of Classification Search
CPC ..... B01F 25/4315; B01F 25/43151; B01F 25/4316; B01F 25/43161
USPC ..... 366/337
See application file for complete search history.

(56) References Cited

U.S. PATENT DOCUMENTS

| | | | | |
|---|---|---|---|---|
| 5,435,061 | A | 7/1995 | Lantz | |
| 5,492,408 | A | 2/1996 | Alfare | |
| 6,224,833 | B1 | 5/2001 | Rall | |
| 6,769,801 | B1 | 8/2004 | Maurer et al. | |
| 8,491,180 | B2 | 7/2013 | Hirschberg et al. | |
| 8,539,761 | B2 | 9/2013 | Lebas et al. | |
| 2002/0060951 | A1* | 5/2002 | Gruetter | B01J 19/32 366/337 |
| 2011/0305103 | A1 | 12/2011 | Mcguire et al. | |
| 2011/0305104 | A1* | 12/2011 | McGuire | B01F 25/43161 366/337 |
| 2013/0172170 | A1 | 7/2013 | Kowalczyk et al. | |
| 2015/0071028 | A1 | 3/2015 | Glanville | |

FOREIGN PATENT DOCUMENTS

| | | | |
|---|---|---|---|
| CN | 205252929 | U | 5/2016 |
| DE | 2810648 | A1 | 9/1979 |
| EP | 0072875 | A1 | 3/1983 |
| EP | 1206962 | A1 | 5/2002 |
| JP | S5827634 | A | 2/1983 |
| JP | H0639123 | U | 5/1994 |
| JP | 3003581 | U | 10/1994 |
| KR | 20050032554 | A | 4/2005 |
| RU | 2076002 | C1 | 3/1997 |
| RU | 2085246 | C1 | 7/1997 |
| RU | 2099133 | C1 | 12/1997 |

OTHER PUBLICATIONS

International Search Report and Written Opinion for International Application No. PCT/IB2020/051146, dated Jul. 9, 2020, 17 pages.
Non Final Rejection received for U.S. Appl. No. 16/281,351, dated Mar. 9, 2022, 12 Pages.
Office Action received for JP Application No. 2020-514278, dated Jun. 7, 2022, 19 Pages (09 Pages of English Translation and 10 Pages of Official notification).

* cited by examiner

STATIC MIXING DEVICES AND METHOD OF MANUFACTURE

CROSS REFERENCE TO RELATED APPLICATIONS

This present application claims priority to U.S. Provisional Patent Application No. 62/555,875 filed Sep. 8, 2017 the disclosures of which are incorporated by reference herein.

BACKGROUND OF THE INVENTION

The present invention relates generally to the mixing of fluids and, more particularly to motionless or static mixing devices for the mixing of fluids and a method of manufacturing the static mixing unit.

Static mixing devices are widely used in various applications to cause blending or fluidization of multi-component mixtures, as well as to facilitate the chemical reaction, heat transfer and/or mass transfer of fluid streams. A series of the static mixing devices are typically positioned end-to-end within a pipe or other conduit through which the multi-component mixtures or fluid streams are flowing, with adjacent static mixing devices rotated with respect to each other at a preselected angle about a longitudinal axis of the conduit.

One popular type of static mixing device uses two or more grids of blade-like crossing elements that are arranged to intersect with each other at a preselected angle and to also be positioned at an angle to the longitudinal axis of the conduit. The crossing elements in each grid are spaced apart a distance corresponding to the width of the crossing elements of the intersecting grid so that the crossing elements of the intersecting grids are interleaved with and are in sideways contact with each other at crossing points. These contacting crossing elements are typically individual elements that must be held in place and then welded together at the crossing points to secure them together.

The construction of the intersecting grids of the static mixing devices by welding together the individual contacting crossing elements is a time-consuming and labor-intensive process. Moreover, in applications, such as polymer mixing, where the static mixing device is subject to high pressure drops, these welds at the side edges of the crossing elements are subjected to high stresses that may over time cause failure of the welds. U.S. Pat. No. 5,435,061 discloses one approach to simplifying the construction process by using a metal casting process to form portions or subassemblies of the static mixing device. The subassemblies are then joined together to form the static mixing device. While the number of welds required to construct the static mixing device is reduced in this process, a need remains for a process of constructing static mixing devices that increases the strength of the static mixing devices by reducing the number of welds, but which also does not require the casting of subassemblies.

SUMMARY OF THE INVENTION

In one aspect, the present invention is directed to a static mixing device subassembly, said subassembly comprising: a first grid formed of a first set of spaced-apart and parallel-extending deflector blades; a second set of spaced-apart and parallel-extending deflector blades that are interleaved with and cross the second set of deflector blades at a preselected angle, adjacent ones of the interleaved deflector blades in the first and second sets each having opposite ends and side edges, the side edges having uncut portions that join the adjacent ones of the interleaved deflector blades along a transverse strip where the deflector blades cross and cut portions that extend from the uncut portions to the opposite ends of the deflector blades, the deflector blades in the second grid each having a bent portion that places segments of the deflector blade on opposite sides of the uncut portion in offset planes; a third grid formed of a third set of spaced-apart and parallel-extending deflector blades; and a fourth set of spaced apart and parallel-extending deflector blades that are interleaved with and cross the third set of deflector blades at a preselected angle, adjacent ones of the interleaved deflector blades in the third and fourth sets each having opposite ends and side edges, the side edges having uncut portions that join the adjacent ones of the interleaved deflector blades along a transverse strip where the deflector blades cross and cut portions that extend from the uncut portions to the opposite ends of the deflector blades, the deflector blades in the fourth grid each having a bent portion that places segments of the deflector blade on opposite sides of the uncut portion in offset planes. One of the ends in at least some of the deflector blades in the first set is uncut and is interconnected with an uncut one of the ends of the deflector blades in the third set along a reverse bend that aligns the first and second grids of deflector blades with the third and fourth grids of deflector blades.

In another aspect, the invention is directed to a static mixing device subassembly, said subassembly comprising: a first grid formed of a first set of spaced-apart, parallel-extending, planar deflector blades; a second set of spaced-apart, parallel-extending, planar deflector blades that are interleaved with and cross the second set of deflector blades at an included angle within the range of 45 to 135 degrees, adjacent ones of the interleaved deflector blades in the first and second sets each having opposite ends and linear side edges, the side edges having uncut portions that join the adjacent ones of the interleaved deflector blades along a transverse strip where the deflector blades cross and cut portions that extend from the uncut portions to the opposite ends of the deflector blades, the deflector blades in the second grid each having a bent portion that places segments of the deflector blade on opposite sides of the uncut portion in offset planes; a third grid formed of a third set of spaced-apart, parallel-extending, planar deflector blades; and a fourth set of spaced apart, parallel-extending, planar deflector blades that are interleaved with and cross the third set of deflector blades at an included angle within the range of 45 to 135 degrees, adjacent ones of the interleaved deflector blades in the third and fourth sets each having opposite ends and linear side edges, the side edges having uncut portions that join the adjacent ones of the interleaved deflector blades along a transverse strip where the deflector blades cross and cut portions that extend from the uncut portions to the opposite ends of the deflector blades, the deflector blades in the fourth grid each having a bent portion that places segments of the deflector blade on opposite sides of the uncut portion in offset planes that are parallel to each other. One of the ends in at least some of the deflector blades in the first set is uncut and is interconnected with an uncut one of the ends of the deflector blades in the third set along a reverse bend that aligns the first and second grids of deflector blades with the third and fourth grids of deflector blades. One of the ends in each of the deflector blades in the second set is spaced apart from and aligned with one of the ends in each of the deflector blades in the fourth set. The first, second, third and fourth grids have a least one side shaped to conform to a curved longitudinal plane.

In a further aspect, the invention is directed to a static mixing device comprising static mixing device subassemblies in which the interconnected uncut ends of the deflector blades in the first and third sets in one of the static mixing subassemblies are joined to said spaced apart and aligned ends of the deflector blades in the second and fourth sets in an adjacent one of the static mixing subassemblies In a still further aspect, the invention is directed to a method of making the static mixing device, comprising the steps of: cutting and bending a sheet of material to form a plurality of static mixing device subassemblies; and joining adjacent ones of static mixing subassemblies together by joining the uncut ends of the deflector blades in the first and third sets in one of the adjacent static mixing subassemblies to the spaced apart and aligned ends of the deflector blades in the second and fourth sets in the other one of the adjacent static mixing subassemblies

BRIEF DESCRIPTION OF THE DRAWINGS

In the accompany drawings that form part of the specification and in which like reference numerals are used to indicate like components in the various views.

DETAILED DESCRIPTION

Figure 1:
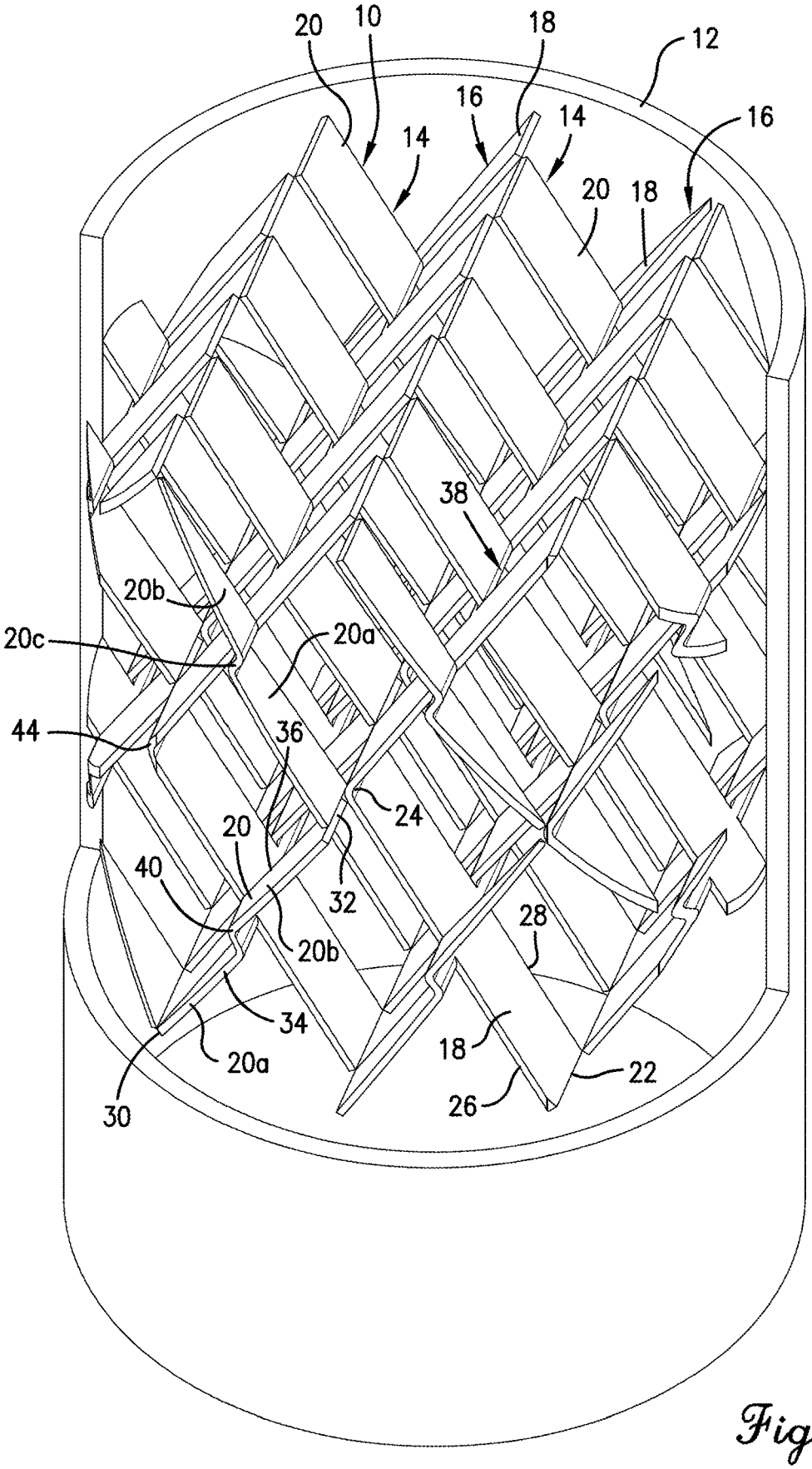
FIG. 1 is a side perspective view of a static mixing device constructed according to an embodiment of the present invention and shown in a fragmentary portion of a conduit.
Figure 2:
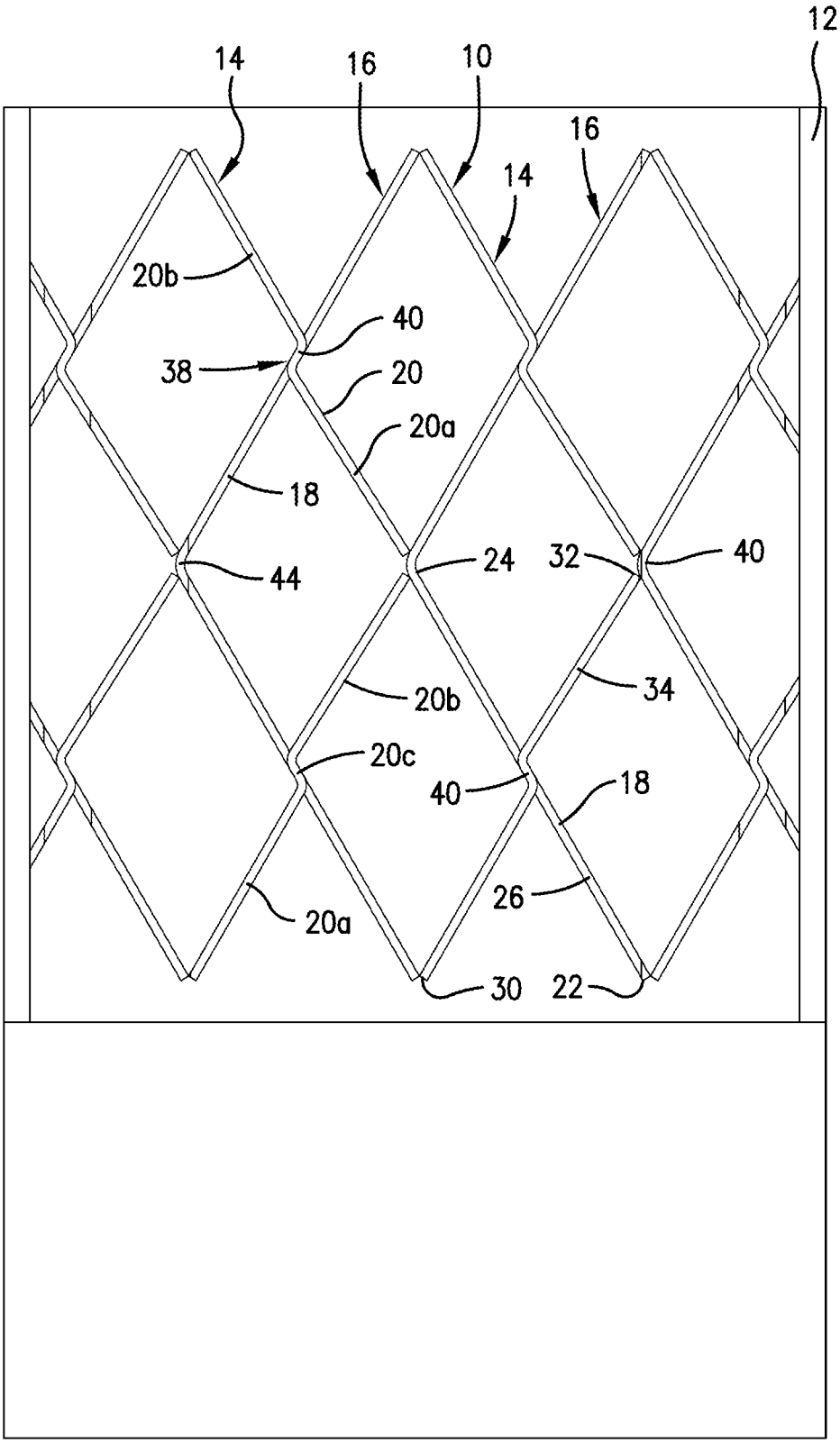
FIG. 2 is a side elevation view of the static mixing device and conduit shown in FIG. 1.
Figure 3:
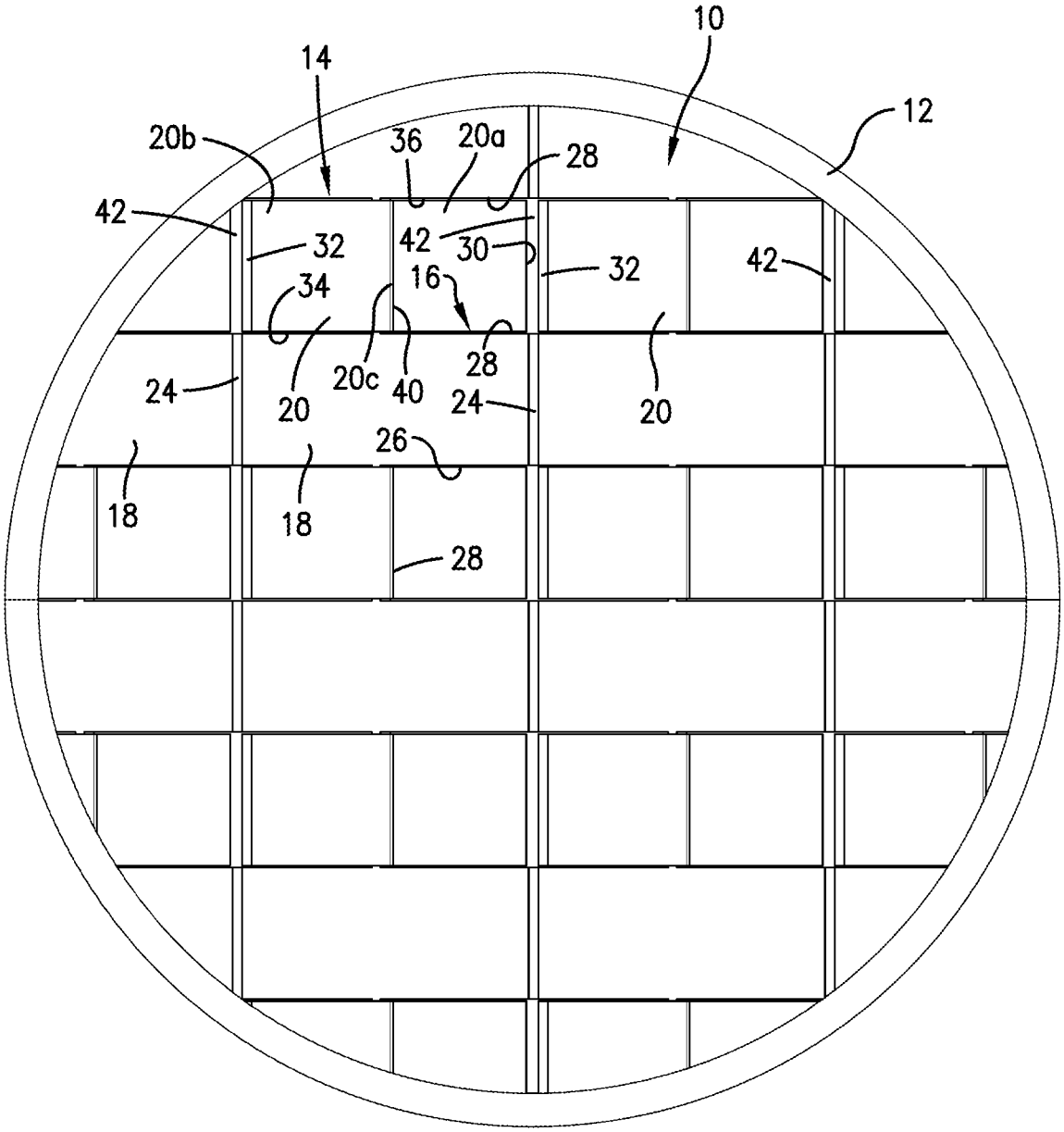
FIG. 3 is a top plan view of the static mixing device and conduit shown in FIGS. 1 and 2.

Turning now to the drawings in greater detail and initially to FIGS. 1-3, one embodiment of a static mixing device is designated generally by the numeral 10 and is shown within a cylindrical conduit 12 through which fluid streams are intended to flow and mix together as they pass through the static mixing device 10. The static mixing device 10 fills a cross section of the conduit 10. Although only a single static mixing device 10 is illustrated, multiple static mixing devices 10 are normally positioned in end-to-end relationship within the conduit 12, with adjacent ones of the static mixing devices 10 rotated with respect to each about a longitudinal center axis of the conduit 12.

The static mixing device 10 comprises intersecting grids 14 and 16 comprised of crossing elements in the form of spaced-apart and parallel deflector blades 18 and 20, respectively. The grids 14 and 16, and the individual deflector blades 18 and 20, cross each other at an included angle that may in one embodiment be within the range of 45 to 135 degrees and in another embodiment be within the range of 60 to 120 degrees. The grids 14 and 16 and deflector blades 18 and 20 are also positioned at an angle, which is normally one-half of the included angle, with respect to the longitudinal center axis of the conduit 12.

The deflector blades 18 in each of the grids 14 are interleaved with and cross the deflector blades 16 in each of the associated intersecting grids 16. The deflector blades 18 and 20 may be in the form of rectangular strips, except that the deflector blades 18 and 20 that are positioned nearest the inner surface of the conduit 12 are shaped to conform to the shape of the inner surface of the conduit 12. The deflector blades 18 may be planar and the deflector blades 20 may have two planar segments 20*a* and 20*b* that are positioned in offset planes by a bent portion 20*c*. The offset planes may be parallel to each other.

The deflector blades 18 within each grid 14 have opposed ends 22 and 24 and opposed side edges 26 and 28. The deflector blades 20 within each grid 16 likewise have opposed ends 30 and 32 and opposed side edges 34 and 36. The side edges 26, 28 and 34, 36 of deflector blades 18 and 20, respectively, include uncut portions that join adjacent ones of the interleaved deflector blades 18 and 20 along a transverse strip 38 where the deflector blades 18 and 20 cross each other. This transverse strip 28 creates a strong integral connection between adjacent ones of the deflector blades 18 and 20 that extends across the entire width of each grid 14 and 16 and eliminates the need to position and then weld or otherwise join together individual ones of the deflectors blades 18 and 20. The side edges 26, 28 and 34, 36 include cut portions that extend from the uncut portions to the opposite ends 22, 24 and 30, 32 of the deflector blades 18 and 20, respectively.

The bent portion 20*c* that places the segments 20*a*, 20*b* of the deflector blade 20 in the offset planes may be in the form of an S-shaped bend 40 that incorporates the transverse strip 38. As can be seen in FIG. 3, the S-shaped bend 40 shortens the longitudinal length of the deflector blades 20 in relation to the longitudinal length of the deflector blades 18, thereby creating slit-like openings 42 between the ends 30, 32 of adjacent deflector blades 18 in the solid surface axial projection of the static mixing device 10. These openings 42 and the S-shaped bend 40 in the deflector blades 20 are believed to facilitate mixing of the fluid streams when they are flowing through the static mixing device 10.

Figure 4:
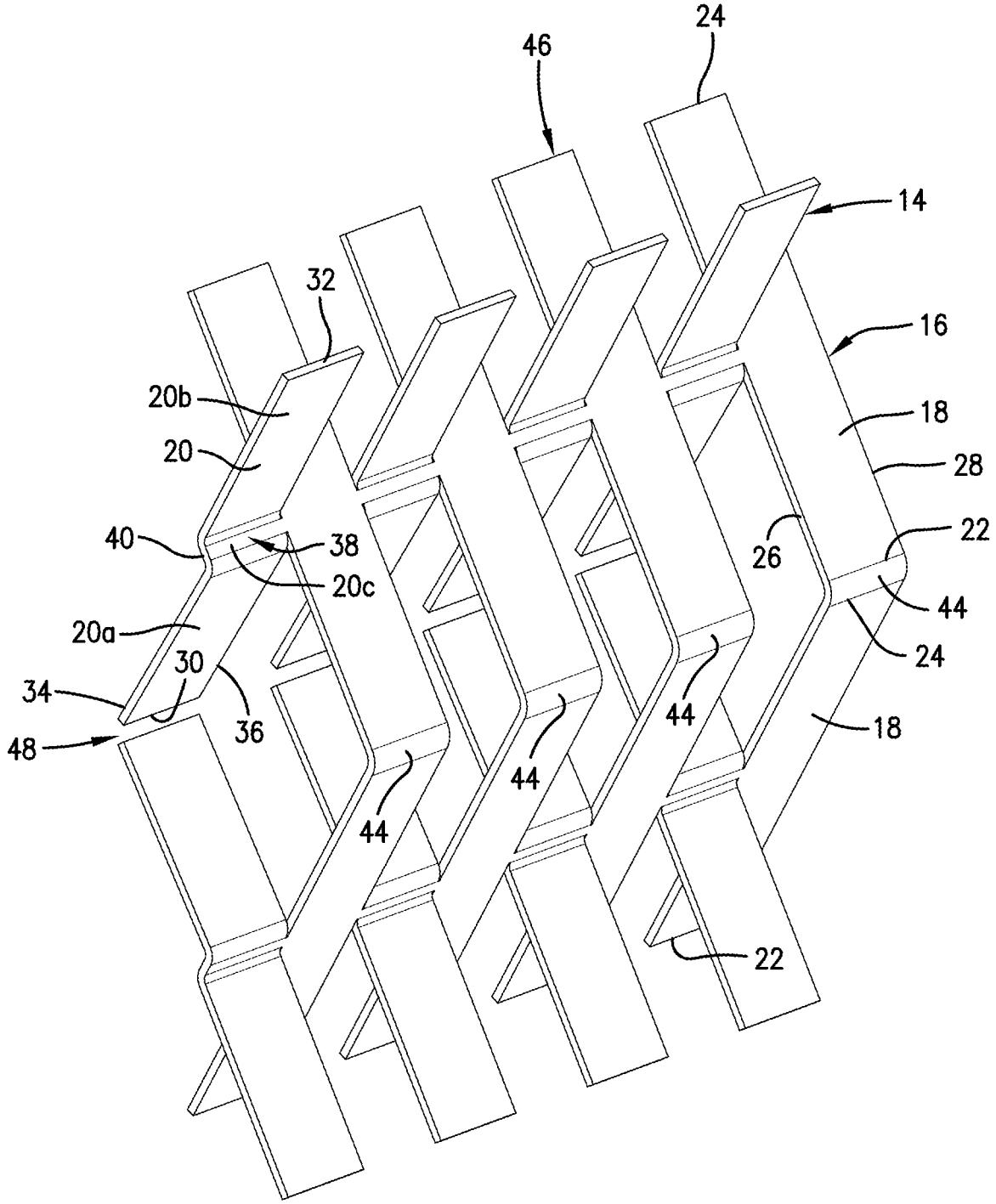
FIG. 4 is a side perspective view of one embodiment of the subassembly of the static mixing device.
Figure 5:
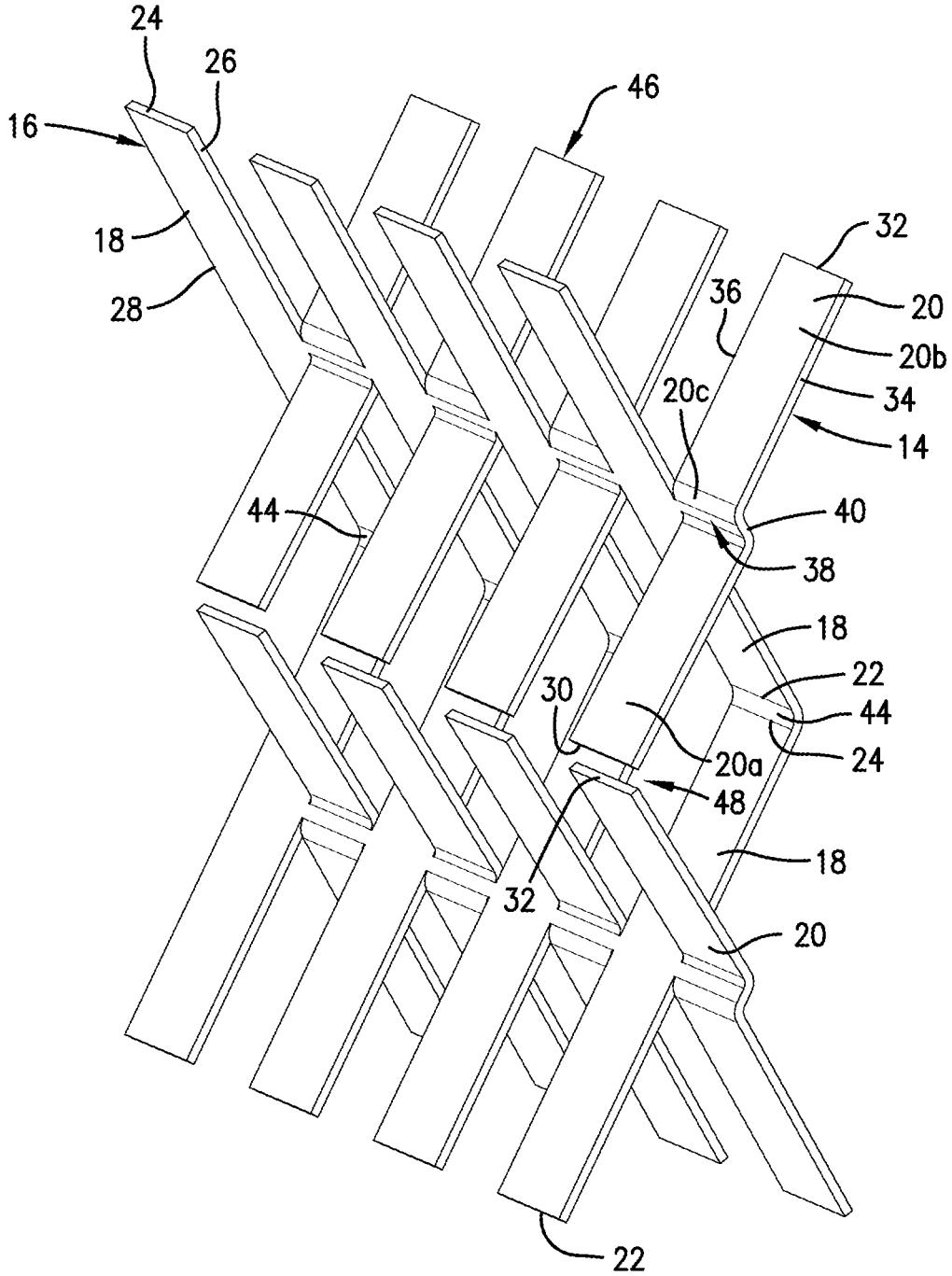
FIG. 5 is a side perspective view of the subassembly of the static mixing device taken from an opposite side from the view shown in FIG. 4.

In each pair of intersecting grids 14 and 16, the end 24 of each one of the deflector blades 18 is uncut and is joined to a similarly uncut end 22 of one of the deflector blades 18 in another one of the intersecting pairs of grids 14 and 16 along a reverse bend 44 that aligns one of the pairs of intersecting grids 14 and 16 with another one of the pairs of intersecting grids 14 and 16 to form a static mixing device subassembly 46 as shown in FIGS. 4 and 5. In another embodiment, the end 24 of only some of the deflector blades 18 is uncut and is joined to a similarly uncut end 22 of one of the deflector blades 18 in another one of the intersecting pairs of grids 14 and 16 along the reverse bend 44 to form the static mixing device subassembly 46.

The interconnected uncut ends 24 and 22 of the deflector blades 18 creates a strong integral connection that eliminates the need to position and then weld together the ends 24 and 22 of individual deflector blades 18. Each deflector blades 18 is shown as having one cut end 22 or 24. In another embodiment the cut end 22 or 24 is replaced by an uncut end 22 or 24 that is then connected to an uncut end 22 or 24 of the deflector blades 18 in a further one of the intersecting pairs of grids 14 and 16 along another one of the reverse bends 44 so that three of the intersecting pairs of grids 14 and 16 are aligned with each other. Additional intersecting pairs of grids 14 and 16 can be joined in this manner.

Figure 6:
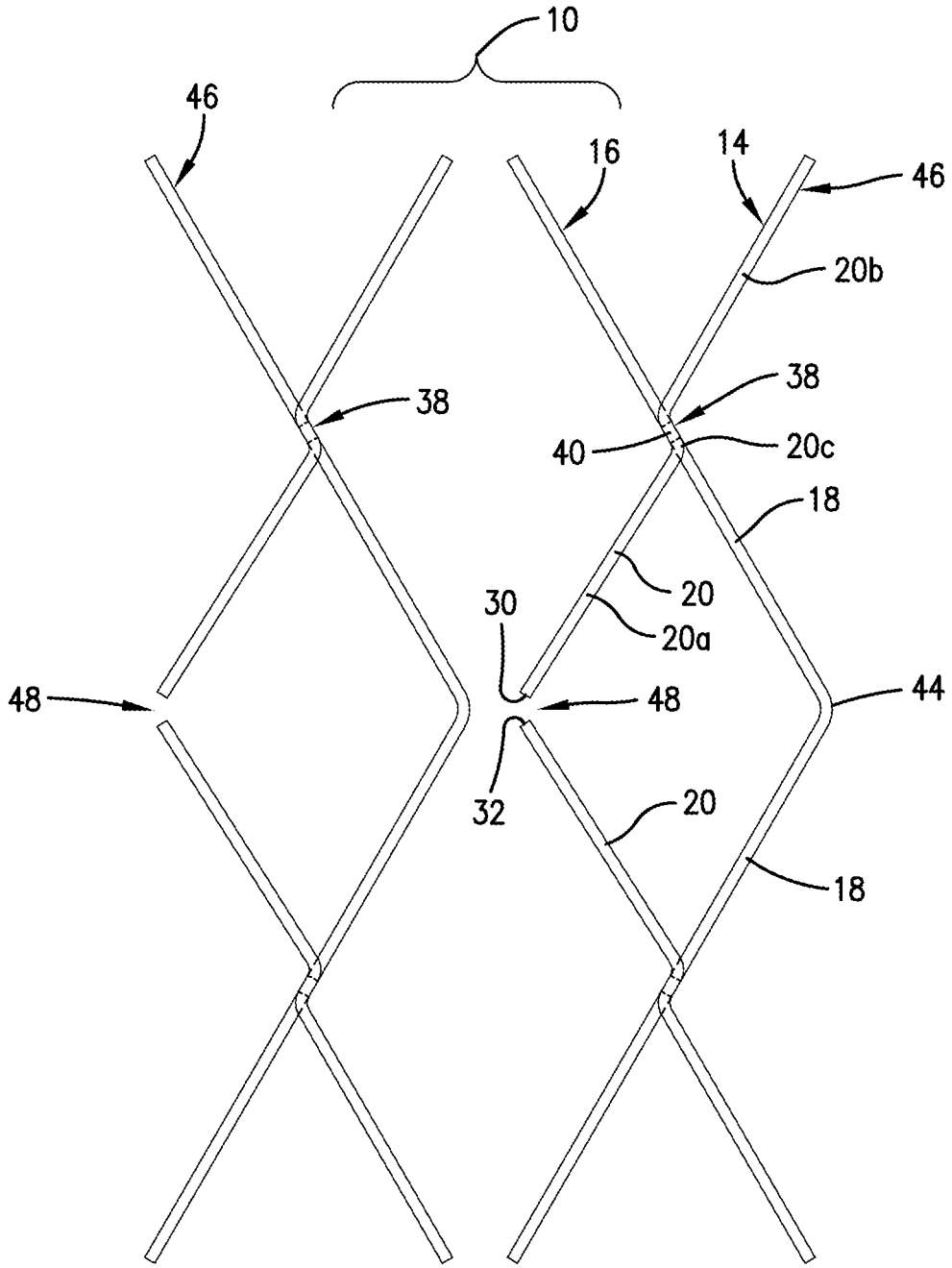
FIG. 6 is an end elevation view of two of the subassemblies of the static mixing devices prior to being joined together.

In one embodiment of the static mixing device subassembly 46, the end 32 of each deflector blade 20 in the grid 16 is spaced from the end 30 of the longitudinally-aligned deflector blade 20 in the adjacent grid 16 to create a gap 48. As illustrated in FIG. 6, the gap 48 may be sized to receive at least some of the reverse bend 44 at the uncut ends 22, 24 of the deflector blades 18 in another of the static mixing device subassemblies 46 so that the ends 32, 30 of the deflector blades 20 may be welded or otherwise secured to the uncut ends 22, 24 of the deflector blades 18 to join the two static mixing device subassemblies 46 together. Additional static mixing device subassemblies 46 can be joined together in this manner.

Figure 7:
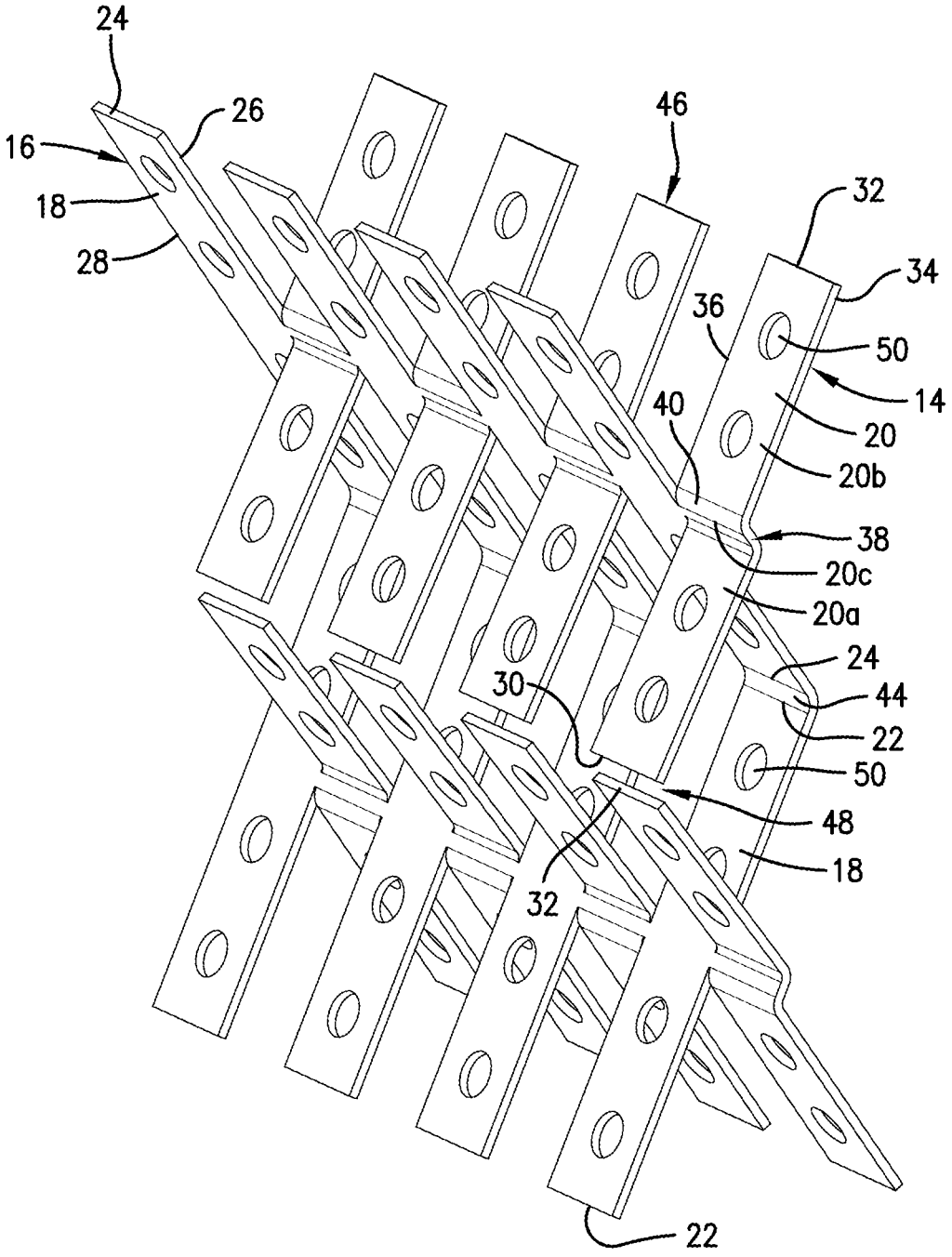
FIG. 7 is a side perspective view of a second embodiment of a subassembly of the static mixing device that incorporates apertures in deflector blades.

In some embodiments, as shown in FIG. 7, some or all of the deflector blades 18 and/or some or all of the deflector blades 20 may include apertures 50 that allow portions of the fluid streams to pass through the deflector blades 18 and/or 20 to facilitate mixing of the fluid streams.

Figure 8:
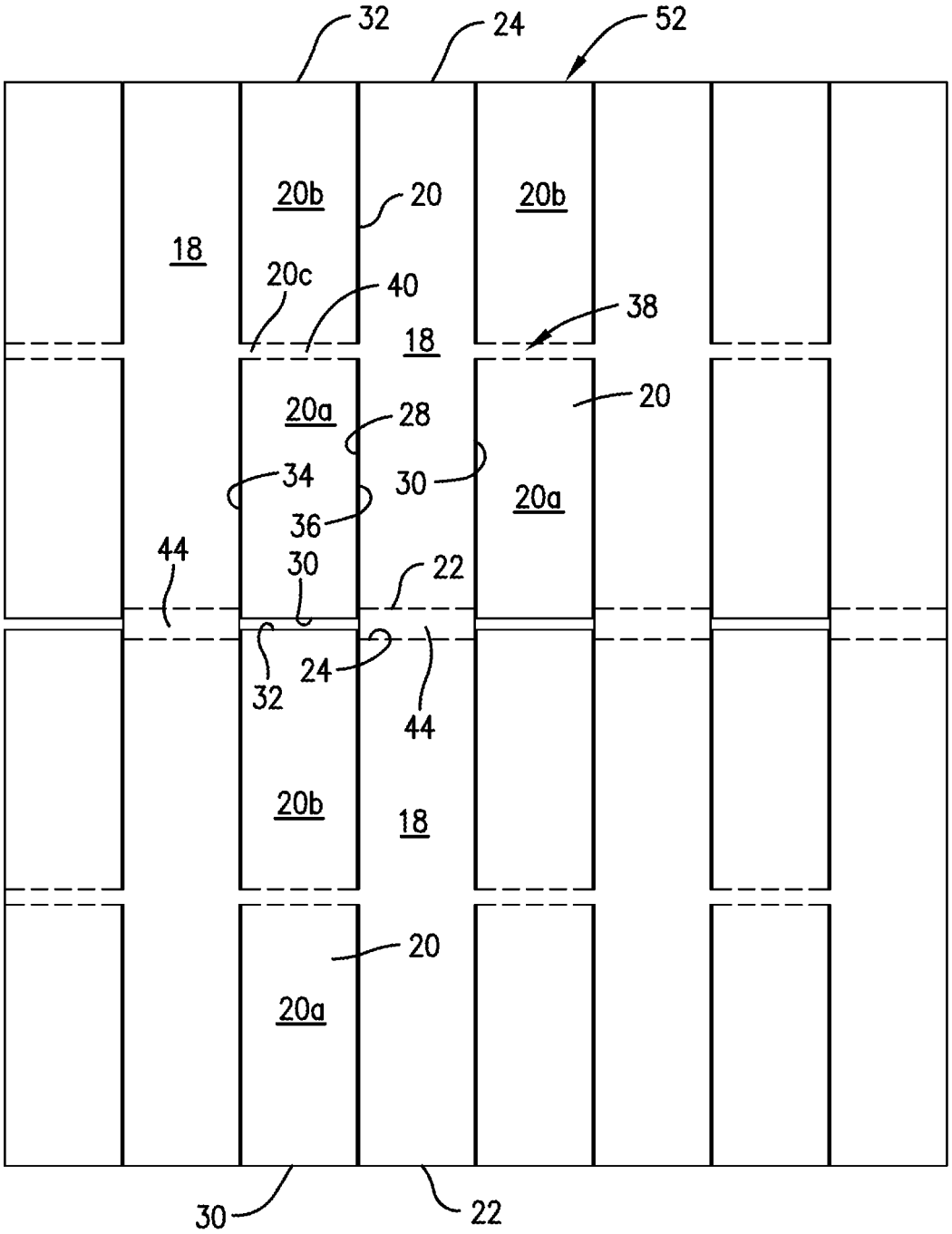
FIG. 8 is a front elevation view of a blank with a series of fold and cut lines that may be used to form a subassembly of the static mixing device.
Figure 9:
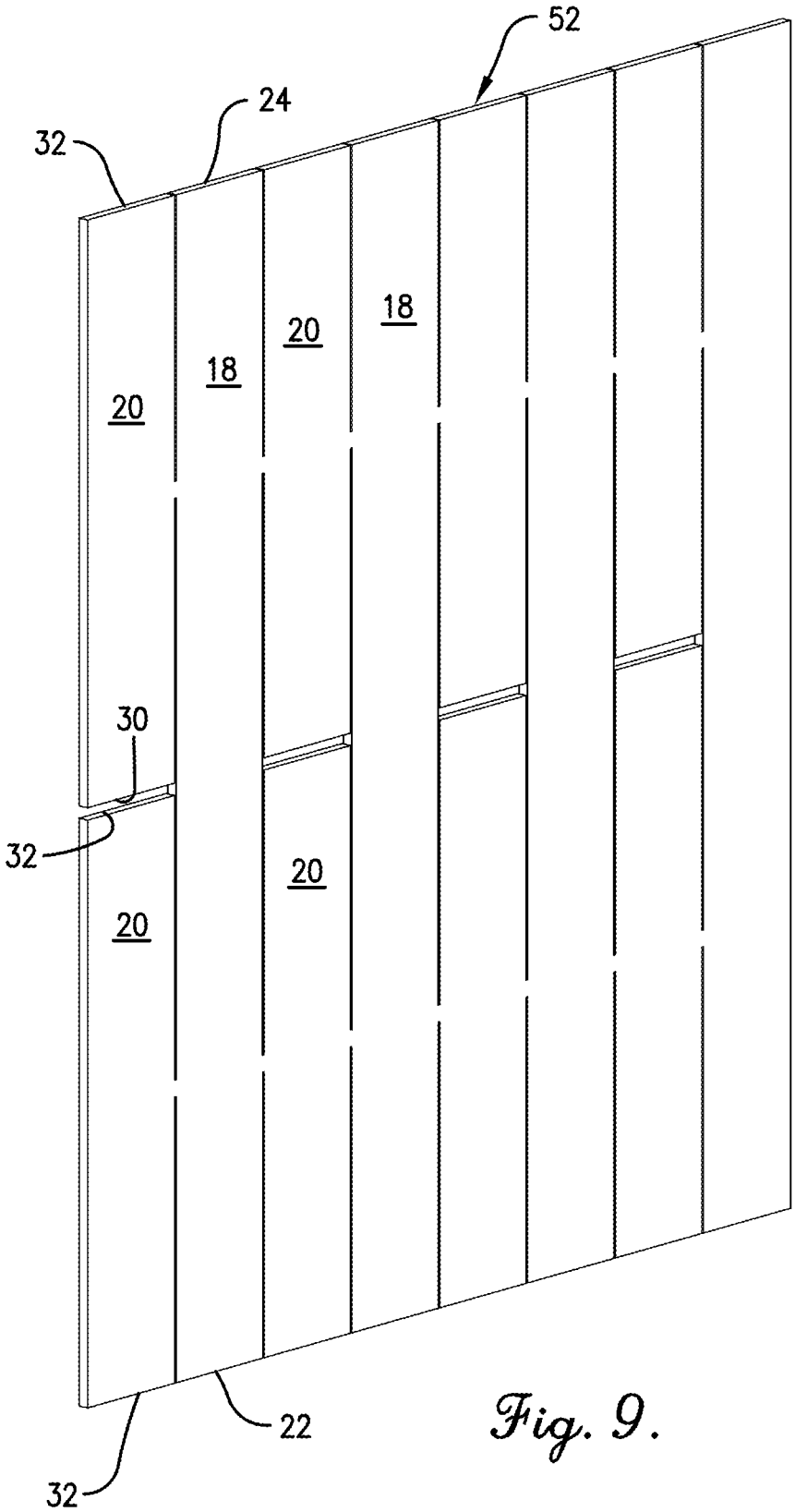
FIG. 9 is a perspective view of the blank shown in FIG. 8.

Turning now to FIGS. 8 and 9, a blank 52 in the form of a planar sheet of a material, such as a metal or an alloy, from which one of the static mixing device subassemblies 46 is illustrated. The blank 52 has been cut to form the cut ends 22, 24 and cut portions of the sides 26, 28 of the deflector blades 18, as well as the cut ends 30, 32 and the cut portions of the sides 34, 36 of the deflector blades 20. The S-shaped bends 40 to be formed in the deflector blades 20 and the reverse bends 44 to be formed between the ends 24 and 22 of longitudinally-adjacent deflector blades 18 are shown by broken lines. After cutting the planar sheet of material to form the blank 52, the static mixing device subassembly 46 is then formed by bending the blank 52 at the locations of the S-shaped bends 40 and the reverse bends 44. Because side-ways adjacent ones of the deflector blades 18 and 20 are integrally joined together at the uncut portions of their sides 26, 28 and 34, 36 along the transverse strip 38 and the longitudinally-adjacent ones of the deflector blades 18 are integrally joined together at their uncut ends 22, 24 along the reverse bend 44, the static mixing device subassembly 46 is formed as a one-piece element without any need for welding together of separate deflector blades. This results in a high-strength static mixing device subassembly 46 that can be fabricated more quickly and less expensively than would otherwise be required if the deflector blades 18 and 20 were required to be welded together. Similarly, the static mixing device 10 can be quickly assembled from the static mixing device subassemblies 46 with a minimum of welding required.

From the foregoing, it will be seen that this invention is one well adapted to attain all the ends and objectives hereinabove set forth together with other advantages that are inherent to the structure.

It will be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A static mixing device subassembly, said subassembly comprising:

a first grid formed of a first set of spaced-apart and parallel-extending deflector blades that each have opposite ends and side edges;

a second grid formed of a second set of spaced-apart and parallel-extending deflector blades that each have opposite ends and side edges and are interleaved with and cross the first set of deflector blades at a preselected angle;

uncut portions in the side edges of the first and second sets of deflectors blades that join adjacent ones of the interleaved deflector blades in the first and second sets of deflector blades along a first transverse strip where the deflector blades in the first and second sets of deflector blades cross;

cut portions in the side edges of the deflector blades in the first and second sets of deflector blades that extend from the uncut portions to the opposite ends of the deflector blades in the first and second sets of deflector blades;

a bent portion in each of the deflector blades in the second set of deflector blades that places segments of the deflector blade on opposite sides of the uncut portion in offset planes, wherein each of the deflector blades in the first set of deflector blades lacks a bent portion that places segments of the deflector blade on opposite sides of the uncut portion in offset planes;

a third grid formed of a third set of spaced-apart and parallel-extending deflector blades that each have opposite ends and side edges;

a fourth grid formed of a fourth set of spaced apart and parallel-extending deflector blades that each have opposite ends and side edges and are interleaved with and cross the third set of deflector blades at a preselected angle;

uncut portions in the side edges of the third and fourth sets of deflectors blades that join adjacent ones of the interleaved deflector blades in the third and fourth sets of deflector blades along a second transverse strip where the deflector blades in the third and fourth sets of deflector blades cross;

cut portions in the side edges of the deflector blades in the third and fourth sets of deflector blades that extend from the uncut portions to the opposite ends of the deflector blades in the third and fourth sets of deflector blades; and a bent portion in each of the deflector blades in the fourth set of deflector blades that places segments of the deflector blade on opposite sides of the uncut portion in offset planes, wherein each of the deflector blades in the third set of deflector blades lacks a bent portion that places segments of the deflector blades on opposite sides of the uncut portion in offset planes, wherein in at least some of the deflector blades in the first set of deflector blades, one of the ends is uncut and is interconnected with an uncut end of one of the deflector blades in the third set of deflector blades along a reverse bend that aligns the first and second grids of deflector blades with the third and fourth grids of deflector blades.

2. The static mixing device subassembly of claim 1, wherein the offset planes of the segments of the deflector blades in the second set of deflector blades are parallel to each other and the offset planes of the segments of the deflector blades in the fourth set of deflector blades are parallel to each other.

3. The static mixing device subassembly of claim 2, wherein one of the ends in each of the deflector blades in the second set of deflector blades is spaced apart from and aligned with one of the ends in each of the deflector blades in the fourth set of deflector blades.

4. The static mixing device subassembly of claim 2, wherein the first, second, third and fourth grids have a least one side shaped to conform to a curved longitudinal plane.

5. The static mixing device subassembly of claim 2, wherein each of the deflector blades in the first and third sets of deflector blades is planar.

6. The static mixing device subassembly of claim 2, wherein the cut portions of the side edges joining the adjacent ones of the deflector blades in the first, second, third and fourth sets of deflector blades are each linear.

7. The static mixing device subassembly of claim 2, wherein the first and second grids cross at an included angle within a range of 45 to 135 degrees and the third and fourth grids cross at an included angled within a range of 45 to 135 degrees.

8. The static mixing device subassembly of claim 2, including apertures in at least some of the deflector blades in the first, second, third and fourth sets of deflector blades.

9. The static mixing device subassembly of claim 2, wherein said one of the ends of each of the deflector blades in the first set of deflector blades is uncut and is interconnected with an uncut one of the ends of the deflector blades in the third set of deflector blades along a reverse bend.

10. A method of making a static mixing device, comprising the steps of:

cutting and bending a sheet of material to form a plurality of static mixing device subassemblies of claim 3; and joining adjacent ones of static mixing subassemblies together by joining the uncut ends of the deflector blades in the first and third sets of deflector blades in one of the adjacent static mixing subassemblies to the spaced apart and aligned ends of the deflector blades in the second and fourth sets of deflector blades in the other one of the adjacent static mixing subassemblies.

11. The method of claim 10, wherein the uncut ends of the deflector blades in the first and third sets of deflector blades in one of the adjacent static mixing subassemblies are joined by welding to the spaced apart and aligned ends of the deflector blades in the second and fourth sets of deflector blades in another one of the adjacent static mixing subassemblies.

12. A static mixing device subassembly, said subassembly comprising:

a first grid formed of a first set of spaced-apart and parallel-extending deflector blades that each have opposite ends and side edges;

a second grid formed of a second set of spaced-apart and parallel-extending deflector blades that each have opposite ends and side edges and are interleaved with and cross the first set of deflector blades at an included angle within a range of 45 to 135 degrees;

uncut portions in the side edges of the first and second sets of deflectors blades that join adjacent ones of the interleaved deflector blades in the first and second sets of deflector blades along a first transverse strip where the deflector blades in the first and second sets of deflector blades cross;

cut portions in the side edges of the deflector blades in the first and second sets of deflector blades that extend from the uncut portions to the opposite ends of the deflector blades in the first and second sets of deflector blades;

a bent portion in each of the deflector blades in the second set of deflector blades that places segments of the deflector blade on opposite sides of the uncut portion in offset planes, wherein each of the deflector blades in the first set of deflector blades lacks a bent portion that places segments of the deflector blade on opposite sides of the uncut portion in offset planes;

a third grid formed of a third set of spaced-apart and parallel-extending deflector blades that each have opposite ends and side edges;

a fourth grid formed of a fourth set of spaced apart and parallel-extending deflector blades that each have opposite ends and side edges and are interleaved with and cross the third set of deflector blades at an included angle within a range of 45 to 135 degrees;

uncut portions in the side edges of the third and fourth sets of deflectors blades that join adjacent ones of the interleaved deflector blades in the third and fourth sets of deflector blades along a second transverse strip where the deflector blades in the third and fourth sets of deflector blades cross;

cut portions in the side edges of the deflector blades in the third and fourth sets of deflector blades that extend from the uncut portions to the opposite ends of the deflector blades in the third and fourth sets of deflector blades; and a bent portion in each of the deflector blades in the fourth set of deflector blades that places segments of the deflector blade on opposite sides of the uncut portion in offset planes, wherein each of the deflector blades in the third set of deflector blades lacks a bent portion that places segments of the deflector blade on opposite sides of the uncut portion in offset planes, wherein in at least some of the deflector blades in the first set of deflector blades, one of the ends is uncut and is interconnected with an uncut end of one of the deflector blades in the third set of deflector blades along a reverse bend that aligns the first and second grids of deflector blades with the third and fourth grids of deflector blades.

13. The static mixing device subassembly of claim 12, including apertures in at least some of the deflector blades in the first, second, third and fourth sets of deflector blades.

14. The static mixing device subassembly of claim 12, wherein said one of the ends of each of the deflector blades in the first set of deflector blades is uncut and is interconnected with an uncut one of the ends of the deflector blades in the third set of deflector blades along a reverse bend.

15. A static mixing device comprising:

a first static mixing device subassembly and a second static mixing device subassembly, the first and second static mixing device subassemblies each comprising:

a first grid formed of a first set of spaced-apart and parallel-extending deflector blades that each have opposite ends and side edges;

a second grid formed of a second set of spaced-apart and parallel-extending deflector blades that each have opposite ends and side edges and are interleaved with and cross the first set of deflector blades at a preselected angle;

uncut portions in the side edges of the first and second sets of deflectors blades that join adjacent ones of the interleaved deflector blades in the first and second sets of deflector blades along a first transverse strip where the deflector blades in the first and second sets of deflector blades cross;

cut portions in the side edges of the deflector blades in the first and second sets of deflector blades that extend from the uncut portions to the opposite ends of the deflector blades in the first and second sets of deflector blades;

a bent portion in each of the deflector blades in the second set of deflector blades that places segments of the deflector blade on opposite sides of the uncut portion in offset planes that are parallel to each other;

a third grid formed of a third set of spaced-apart and parallel-extending deflector blades that each have opposite ends and side edges;

a fourth grid formed of a fourth set of spaced apart and parallel-extending deflector blades that each have opposite ends and side edges and are interleaved with and cross the third set of deflector blades at a preselected angle;

uncut portions in the side edges of the third and fourth sets of deflectors blades that join adjacent ones of the interleaved deflector blades in the third and fourth sets of deflector blades along a second transverse strip where the deflector blades in the third and fourth sets of deflector blades cross;

cut portions in the side edges of the deflector blades in the third and fourth sets of deflector blades that extend from the uncut portions to the opposite ends of the deflector blades in the third and fourth sets of deflector blades;

a bent portion in each of the deflector blades in the fourth set of deflector blades that places segments of the deflector blade on opposite sides of the uncut portion in offset and parallel planes, wherein in at least some of the deflector blades in the first set of deflector blades, one of the ends is uncut and is interconnected with an uncut end of one of the deflector blades in the third set of deflector blades along a reverse bend that aligns the first and second grids of deflector blades with the third and fourth grids of deflector blades, wherein one of the ends in each of the deflector blades in the second set of deflector blades is spaced apart from and aligned with one of the ends in each of the deflector blades in the fourth set of deflector blades; and the first static mixing device subassembly being positioned adjacent to the second static mixing device subassembly with the interconnected uncut ends of the deflector blades in the first and third sets of deflector blades in the first static mixing subassembly being joined to said spaced apart and aligned ends of the deflector blades in the second and fourth sets of deflector blades in the second static mixing subassembly.

16. The static mixing device of claim 15, wherein each of the deflector blades in the first set of deflector blades lacks a bent portion that places segments of the deflector blade on opposite sides of the uncut portion in offset planes and each of the deflector blades in the third set of deflector blades lacks a bent portion that places segments of the deflector blade on opposite sides of the uncut portion in offset planes.

17. The static mixing device of claim 15, wherein the first, second, third and fourth grids have a least one side shaped to conform to a curved longitudinal plane.

18. The static mixing device of claim 15, wherein each of the deflector blades in the first and second sets of deflector blades is planar.

19. The static mixing device of claim 15, wherein the cut portions of the side edges joining the adjacent ones of the deflector blades in the first, second, third and fourth sets of deflector blades are each linear.

20. The static mixing device of claim 15, wherein the first and second grids cross at an included angle within a range of 45 to 135 degrees.

21. The static mixing device of claim 15, including apertures in at least some of the deflector blades in the first, second, third and fourth sets of deflector blades.

* * * * *